US005533733A

United States Patent [19]

Dirnbeck

[11] Patent Number: 5,533,733

[45] Date of Patent: Jul. 9, 1996

[54] SPORTS GOAL

[76] Inventor: Ronald J. Dirnbeck, 1700 Flamingo, Florissant, Mo. 63031

[21] Appl. No.: 524,532

[22] Filed: Sep. 7, 1995

[51] Int. Cl.[6] ..... A63B 63/00

[52] U.S. Cl. ..... 273/400; 273/127 B

[58] Field of Search ..... 273/400, 127 R, 273/127 A, 127 B, 127 C, 127 D

[56] References Cited

U.S. PATENT DOCUMENTS

| | | | |
|---|---|---|---|
| 2,449,708 | 9/1948 | Lindsay | 273/127 B |
| 2,525,304 | 10/1950 | Lindsay | 273/127 B |
| 3,501,150 | 3/1970 | Frischman | 273/127 R |
| 3,642,282 | 2/1972 | Frischman | 273/127 B |
| 3,698,715 | 10/1972 | Browning et al. | 273/127 B |
| 4,083,561 | 4/1978 | Daffer, Jr. | 273/103 |
| 4,407,507 | 10/1983 | Caruso et al. | 273/400 |
| 4,826,166 | 5/1989 | Baker et al. | 273/55 R |
| 4,842,283 | 6/1989 | LeBel et al. | 273/392 |
| 4,905,996 | 3/1990 | Tallent et al. | 273/26 A |
| 5,080,375 | 1/1992 | Moosavi | 273/400 |
| 5,186,469 | 2/1993 | Terris | 273/400 |
| 5,193,802 | 3/1993 | Saltus | 273/26 A |
| 5,244,213 | 9/1993 | Armell | 273/400 |
| 5,246,226 | 9/1993 | McGuinn | 273/26 E |
| 5,308,082 | 5/1994 | Bigelow | 273/400 |
| 5,351,948 | 10/1994 | Thomas | 273/26 A |
| 5,431,411 | 7/1995 | Padilla | 273/400 |

FOREIGN PATENT DOCUMENTS 2847701 11/1978 Germany .

*Primary Examiner*—William H. Grieb
*Attorney, Agent, or Firm*—Grace J. Fishel

[57] ABSTRACT

A sports goal having a pair of U-shaped, open ended frames pivoted together at their open ends and, in erect position, connected in the middle by a dogleg brace. A net is attached to the first and second frames and draped over the brace forming the goal. The brace is easily removable from between the frames for storage and fits inside the frames cradled in the net when the frames are pivoted substantially parallel to each other.

8 Claims, 2 Drawing Sheets

SPORTS GOAL

BACKGROUND OF THE INVENTION

1. Field of the Invention

The present invention relates to a sports goal having a frame that folds flat with a center brace stored in the net. The goal is lightweight but sturdy, easy to assemble and breakdown and is particularly adapted for (but not limited to) street hockey.

2. Brief Description of the Prior Art

Street hockey is played with a plastic puck or light ball by players mounted on roller blades. It is popular because a game can be set up in a street or driveway unlike soccer or softball which require a large playing area and, in the case of soccer, a goal which is usually permanently mounted in the field. Street hockey is mainly played by kids. Most street hockey goals typically come as a kit with tubular metal pieces that are assembled into a frame having a U-shaped upright member joined to a U-shaped bottom member by diagonal side braces. A net is wrapped or threaded over the U-shaped members. Once assembled, a street hockey goal is bulky to store in a garage or the like because ordinary goals do not fold and are not easily disassembled into their component parts. Whether sat on the floor or hung from the wall, they occupy a large space and always seem to be in the way. In addition, a fully erect, ordinary street hockey goal is harder to carry than it would be if it was folded flat. Toggle links in the diagonal side braces and other mechanical linkages used to fold soccer goals are not adaptable to street hockey goals because they must be kept simple.

SUMMARY OF THE INVENTION

In view of the above, it is an object of the present invention to provide a sports goal that is particularly adapted to street hockey but, as discussed below can be used in other games with light balls, the sports goal having a frame that folds flat. It is another object to provide a sports goal which can be provided as an inexpensive kit of tubular pieces that can be readily assembled. It is also an object to provide a portable sports goal with a lightweight sturdy frame that can be used indoors and out. Other objects and features of the invention will be in part apparent and in part pointed out hereinafter.

In accordance with the invention, a sports goal has a first U-shaped, open ended frame, a second U-shaped, open ended frame, a center brace and a net. The first frame has a pair of legs extending to free ends forming goal post uprights and a bite forming a goal crossbar.

The second frame has a pair of legs extending to free ends forming side rails and a bite forming a bottom rail. The free ends of the legs of the first and second frames are connected on a common axis whereby the U-shaped frames can rotate into a position substantially parallel to each other.

The center brace has a longer first leg and a shorter second leg. The first and second legs form a dogleg and extend to free ends that are received in couplings provided on the bite of the first and second frames. The free ends of the brace are readily removable from the couplings so that the goal can be broken down. The center brace is dimensioned so that the first frame is held in an erect position with respect to the second frame when the free ends of the first and second legs of the center brace are received in the couplings.

The net is attached to the first and second frames and draped over the center brace when the goal is in erect position. When the goal is folded, the center brace is stored in the net between the first and second frames.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
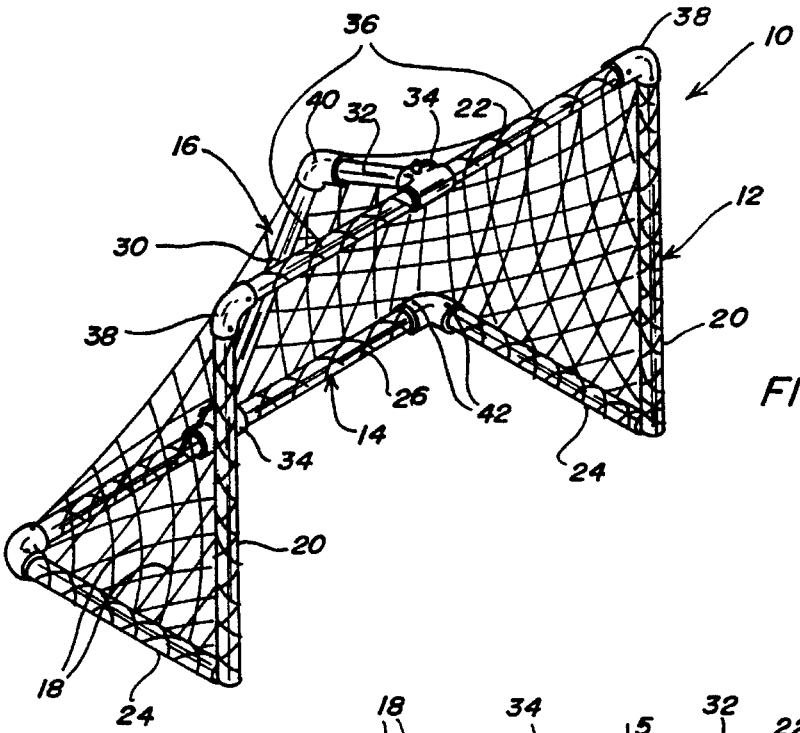
FIG. 1 is a perspective view of a sports goal in accordance with the present invention.
Figure 2:
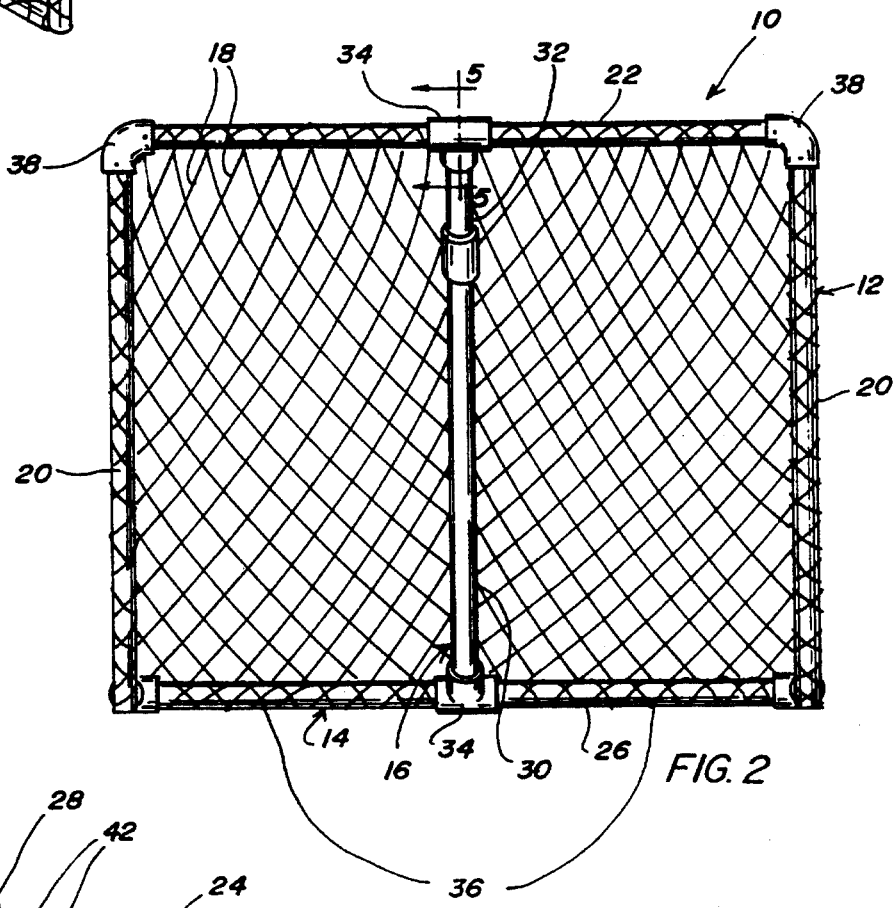
FIG. 2 is a front view of the goal.

Referring to the drawings more particularly by reference character, reference numeral 10 refers to a sports goal in accordance with the present invention. For purposes of economy, goal 10 is preferably formed, as more particularly described below, from sections of standard plastic pipe with standard couplings. A good balance of weight and strength is obtained with 1½ inch PVC pipe and couplings and, for that reason, polyvinyl chloride plastic pipe and couplings are particularly preferred, although goal 10 could be made from metal or the like.

With continuing reference to the drawings, goal 10 in major part includes a first U-shaped, open ended frame 12, a second U-shaped, open ended frame 14, a center brace 16 and a net 18. First U-shaped frame 12 has a pair of legs 20 extending to free ends forming goal post uprights and a bite 22 forming a goal crossbar. Second U-shaped frame 14 is similarly formed with a pair of legs 24 extending to free ends forming side rails and a bite 26 forming a bottom rail. Legs 24 of second frame 14 are shorter than legs 20 of the first frame such that first frame 12 is taller than second frame 14 is deep.

Figure 6:
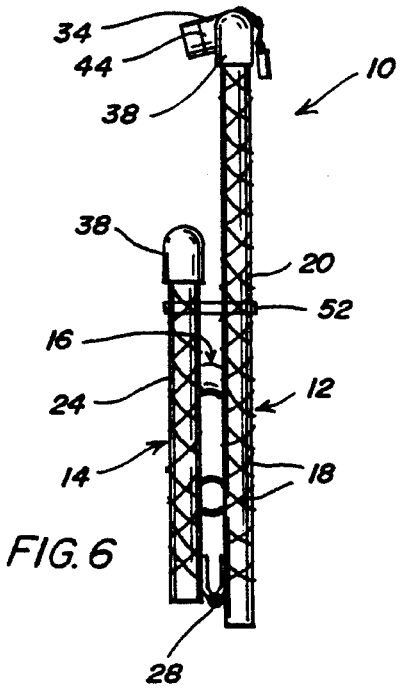
FIG. 6 is a side view of the sports goal in folded condition with the center brace stored in the net; and, FIG. 7 is a front view of the sports goal in folded condition with the center brace stored in the net.
Figure 4:
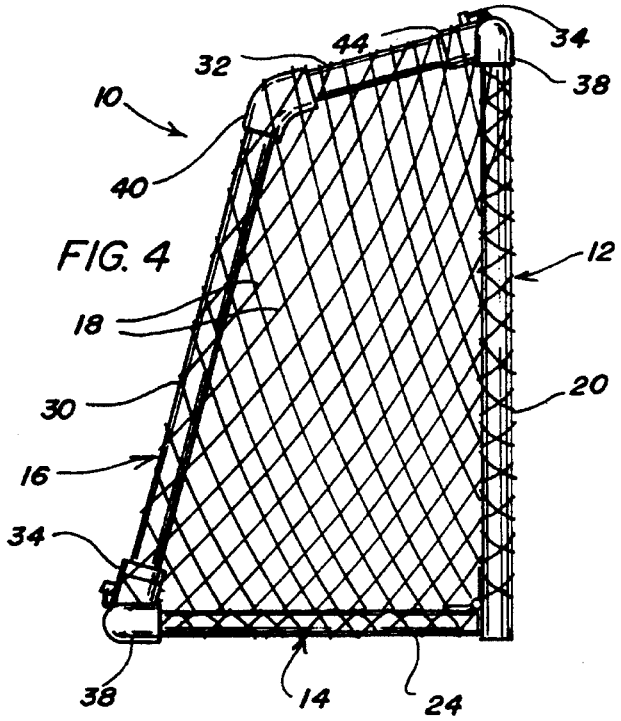
FIG. 4 is a side view of the sports goal.
Figure 5:
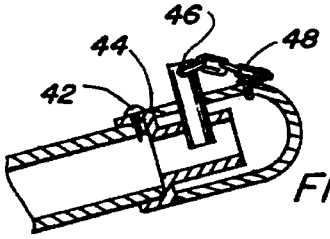
FIG. 5 is a sectional view taken along line 5—5 in FIG. 2.
Figure 7:
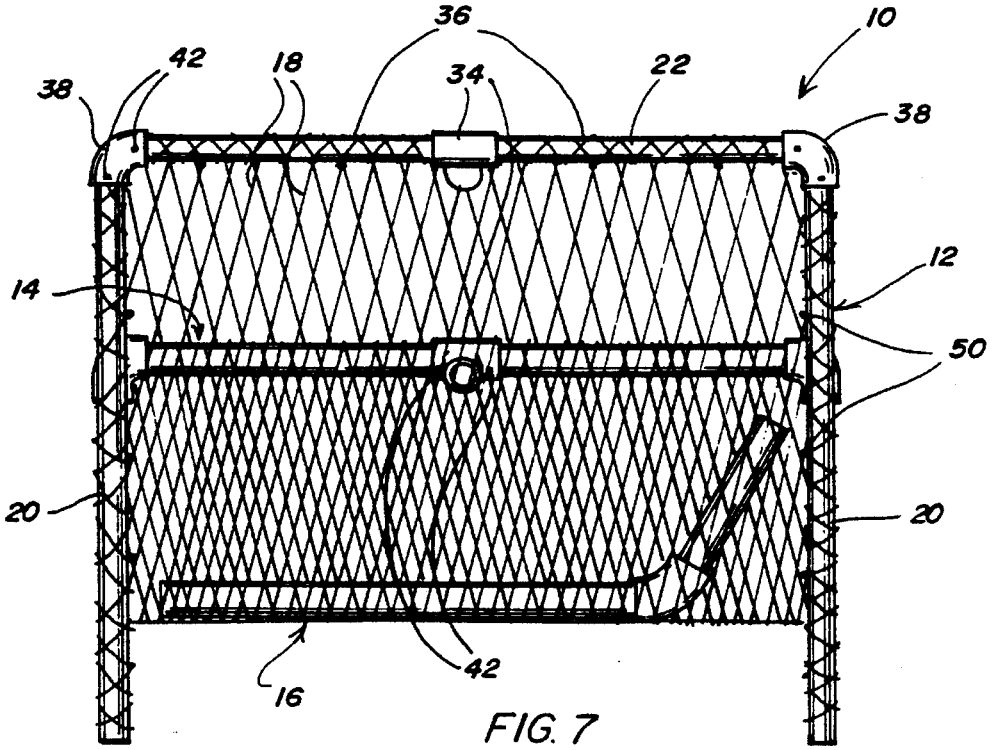

The free ends of legs 20, 24 of first and second frames 12, 14, respectively, are connected on a common axis 28 whereby the frames can rotate into a position substantially parallel to each other. Center brace 16 has a longer first leg 30 and a shorter second leg 32 extending to free ends and connected together to form a dogleg. The free ends of first and second legs 30, 32 are received in couplings 34 provided on bites 22, 26 of first and second frame 12, 14, respectively. Center brace 16 is dimensioned so that first frame 12 is held in an erect position with respect to second frame 14 when the free ends of first and second legs 30, 32, are received in couplings 34. Center brace 16 is also dimensioned such that it fits between legs 20, 24 cradled in net 18 as shown in FIGS. 6 and 7.

Couplings 34 may be T-joints (preferably 90° T-joints) with arm sockets and a stem socket. Bites 22, 26 are of equal length and are formed from two pair of arms 36 received in the arm sockets of T-joints 34 such that arms 36 in each bite are linked in a line and frictionally held in the T-joint. Opposite ends of bites 22, 26 are received in end sockets of four elbows 38 (preferably 90° elbows) as are legs 20, 24 to form frames 12, 14, respectively. The dogleg in brace 16 may be formed with an elbow 40 (preferably a 45° elbow) with sockets into which are received legs 30, 32 opposite the free ends thereof. Legs 20, 24 and arms 36 are frictionally engaged in elbows 38 while legs 30, 32 are frictionally engaged in elbow 40. While the friction fit between the various tubular pipe sections and T-joints and elbows should be sufficient to hold the goal together during assembly, it is preferred that the connection be fixed with screws 42, such as ½ inch panhead screws, passing through the sidewalls of the joints and elbows and into the sidewalls of the pipe sections forming the various legs and arms.

Figure 3:
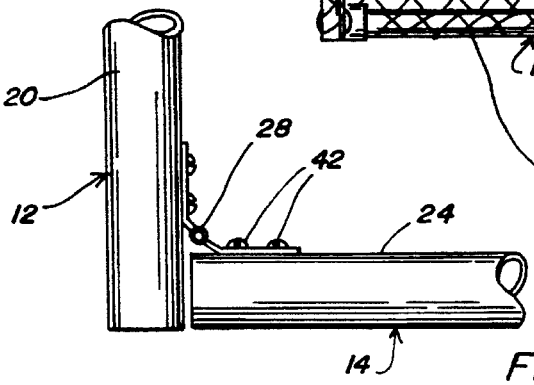
FIG. 3 is a side view, on an enlarged scale, of the free ends of the open U-shaped frames joined with a strap hinge.

Axis 28 may take the form of a pair of strap hinges attached with screws 42 to legs 20, 24 such that in erect position, the free end of legs 24 are in near abutment against the sides of legs 20 near their free ends. As best seen in FIG. 3, this arrangement stops frame 12 from pivoting much beyond 90° but allows some flexibility such that brace 16 can be removed from couplings 34.

Brace 16 must be readily removable from couplings 34 so that goal 10 can be easily broken down and folded for storage. When legs 30, 32 are formed of PVC pipe, for example, this may be accomplished by attachment of an adapter 44 with a nipple having an outside diameter smaller than the outside diameter of the leg so that the legs fit loosely in couplings 34 (e.g., the stem socket of the T-joints). A retaining means 46 such as a pin passing though the sidewalls of T-joint 34 and the sidewalls of adapter 44 may be used for holding brace 16 in the T-joints when the goal is erected. Without pin 46, brace 16 might be accidentally knocked out of T-joint 34 and goal 10 collapse. Retaining pins 46 may be attached to a strap 48 such as a chain, etc., the opposite end of which may be attached to T-joint 34 with one of screws 42 used to fix arms 36 in the T-joint. Strap 48 prevents retaining pins 46 from getting lost when the goal is in stored condition.

Net 18 is attached to frames 12, 14 and, in erect position, draped over brace 16 which is on the inside of the goal. While the net can be attached in a variety of ways, including weaving legs 20, 24 and arms 36 through the holes in the net, a plurality of plastic tie wraps 50 are preferably used. When tie wraps are used, the outer edge of the net is wrapped around the first and second frames, tie wraps 50 are then looped through the outer edge of the net and an inner portion of the net and tied, securing the net in place. A strap 52, with a buckle, hook and pile (e.g., VELCRO) fasteners or the like, may be provided for securing goal 10 in folded condition.

Unassembled goal 10 can be packed in a box very compactly. Included in the box, are two legs 20 (for the goal posts), four arms 36 (for the top and bottom rails), two legs 24 (for the side rails), four 90° elbows 38, two T-joints 34, one 45° elbow 40, one leg 30 (for the bottom center support), one leg 32 (for the upper center support), two adapters 44 (such as a 1½ inch to 1¼ inch reducer), two hinges 28, two retainer pins 46 with chains 48, a strap 52 and twenty-eight panhead screws 42. In the form preferably provided, adapters 44 and the sockets of T-joints 34, elbows 38 and elbow 40 are pre-drilled with holes for receipt of screws 42. Similarly T-joints 34 and adapters 44 are pre-drilled with holes for receipt of retainer pins 46. Pilot holes are drilled in the free ends of legs 20, 24 for receipt of screws 42 used to attached strap hinges 28.

First (or upright) frame 12 is made by inserting legs 20 in two of 90° elbows 38, making sure that the holes in the elbows are facing up. An arm 36 is inserted in the opposite end of elbows 38 and the two arms joined in the middle with one of T-joints 34. Second (or bottom) frame 14 is similarly made by inserting legs 24 into two of 90° elbows 38, making sure that the holes in the elbows are facing up. In the opposite ends of elbows 38, two arms 36 are inserted, joining the two sections in the middle with one of T-joints 34. One end of strap 52 has a loop which is passed over the free end of one of legs 20. Brace (or center support) 16 is made by inserting first and second legs 30, 32 into 45° elbow 40. An adapter 44 is then placed on each end.

First frame 12 is stood at a 90° angle with respect to second frame 14 with the free ends of legs 24 butted against the side of legs 20 near their free ends. The holes in the legs 20, 24 are aligned and strap hinges 28 attached with screws 42. The free ends of brace 16 outfitted with adapters 44 are inserted into the stem socket of T-joints 34. The T-joints must be pivoted so that the holes in the T-joints and adapters are aligned for receipt of pins 46. With goal 10 assembled, the joints are fixed by starting screws 42 in the pre-drilled holes. One screw 42 is passed through the free end of chain 48 at T-joints 34.

Net 18 is provided as a rectangular piece. Starting at the top middle of goal crossbar 22, the net is wrapped around arms 36 and attached with ties 50, working towards the corners. This operation is repeated along the bottom rail 26 and then along legs 24 forming the side rails. During this operation, brace 16 is on the inside of the net. Starting with a rectangular piece, there will be excess net which would sag if the net were not fitted as it is wrapped about frames 12, 14. Any excess net 18 should be cut off and tie wraps 50 trimmed.

Goal 10 can be easily broken down by releasing retaining means 46, allowing brace 16 to be removed from T-joints 34. First frame 12 can be rotated towards second frame 14 with brace 16 caught in net 18 between the frames. First and second frames 12, 14 can then be secured in folded condition with strap 52. Folded goal 10 can then be easily carried and stored away.

Goal 10 is preferably about 48 inches high by about 54 inches wide. It will be understood, however, that these dimensions are illustrative and not intended to be limiting. Goal 10 can be used inside, for example, for floor hockey in a gymnasium or outside for street hockey. It can also be used by younger children for soccer with a light soccer ball, but is not recommended for use with heavier balls, and is suitable for field hockey because the game is played with a smaller ball. Other purposes will undoubtedly occur to the user.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A sports goal comprising a first U-shaped, open ended frame, said first frame having a pair of legs extending to free ends forming goal post uprights and a bite forming a goal crossbar, a second U-shaped, open ended frame, said second frame having a pair of legs extending to free ends forming side rails and a bite forming a bottom rail, said free ends of said legs of the first and second frames connected on a common axis whereby said U-shaped frames can rotate into a position substantially parallel to each other, a center brace having a longer first leg and a shorter second leg forming a dogleg, said first and second legs extending to free ends, said free ends of said first and second legs of the center brace received in couplings provided on the bite of the first and second U-shaped frames, said center brace dimensioned so that the first U-shaped frame is held in an erect position with respect to the second U-shaped frame when the free ends of the first and second legs of the center brace are received in said couplings, said free ends of the first and second legs of the center brace being readily removable from said couplings, a net attached to the first and second U-shaped frames and draped over the center brace for enclosing the space defined by the U-shaped frames and center brace when the goal is in erect position.

2. The sports goal of claim 1 further comprising a retaining means for holding the free ends of the center brace in the couplings when the goal is erected.

3. The sports goal of claim 2 wherein the common axis is a pair of strap hinges attached to the free ends of the legs of the first and second frames.

4. The sports goal of claim 2 wherein the center brace is dimensioned such that it fits between the legs of the first and second frames, cradled in the net when the first and second frames are rotated about said axis into a position substantially parallel to each other.

5. A sports goal comprising a first U-shaped, open ended frame, said first frame having a pair of legs extending to free ends forming goal post uprights and a pair of arms forming a crossbar, a pair of 90° elbows and a 90° T-joint, said arms received in the T-joint and linked in a line and said arms and legs received in the 90° elbows, said arms and said legs frictionally engaged by said T-joint and elbows, a second U-shaped, open ended frame, said second frame having a pair of legs extending to free ends forming side rails and a pair of arms forming a bottom rail, a pair of 90° elbows and a 90° T-joint, said arms received in the T-joint and linked in a line and said arms and legs received in the 90° elbows, said arms and said legs frictionally engaged by said T-joint and elbows, said free ends of said legs of the first and second frames connected on a common axis with strap hinges whereby said U-shaped frames can rotate into a position substantially parallel to each other, a center brace with a longer first leg, a shorter second leg and a 45° elbow, said first and second legs received in and frictionally engaged by said 45° elbow, said first and second legs extending to free ends, said free ends of said first and second legs of the center brace received in the T-joint, said center brace dimensioned so that the first U-shaped frame is held in an erect position with respect to the second U-shaped frame when the free ends of the first and second legs of the center brace are received in said T-joints, a retaining means for retaining said free ends in said T-joints, said free ends of the first and second legs of the center brace readily removable from said T-joints when said retaining means are released, a net attached to the first and second U-shaped frames and draped over the center brace for enclosing the spaced defined by the U-shaped frames and the center brace when the goal is in erect position.

6. The sports goal of claim 5 wherein the legs of the second frame are shorter than the legs of the first frame whereby the erect goal is taller than it is deep.

7. The sports goal of claim 6 wherein the center brace is dimensioned such that it fits between the legs of the first and second frames, cradled in the net when the first and second frames are rotated about the strap hinges into a position substantially parallel to each other.

8. The sports goal of claim 6 further including a strap for securing the goal in folded condition.

* * * * *